US011295671B2

(12) United States Patent
Cheng et al.

(10) Patent No.: US 11,295,671 B2
(45) Date of Patent: Apr. 5, 2022

(54) DISPLAY DRIVER AND DISPLAY DRIVING METHOD

(71) Applicant: Novatek Microelectronics Corp., Hsinchu (TW)

(72) Inventors: Jhih-Siou Cheng, New Taipei (TW); Po-Hsiang Fang, Hsinchu (TW); Chieh-An Lin, Taipei (TW); Keko-Chun Liang, Hsinchu (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 141 days.

(21) Appl. No.: 16/827,713

(22) Filed: Mar. 24, 2020

(65) Prior Publication Data

US 2021/0304675 A1 Sep. 30, 2021

(51) Int. Cl.
*G09G 3/3258* (2016.01)

(52) U.S. Cl.
CPC ... *G09G 3/3258* (2013.01); *G09G 2300/0833* (2013.01); *G09G 2320/064* (2013.01)

(58) Field of Classification Search
CPC ..... G09G 3/3258; G09G 2320/064; G09G 2300/0833
See application file for complete search history.

(56) References Cited

U.S. PATENT DOCUMENTS

2020/0020278 A1* 1/2020 Lee ..... G09G 3/3275
2020/0058252 A1* 2/2020 Kim ..... G09G 3/3258

* cited by examiner

*Primary Examiner* — Christopher E Leiby
(74) *Attorney, Agent, or Firm* — JCIPRNET

(57) ABSTRACT

A display driver and a display driving method are provided. The display driving is adapted for driving a display panel and sensing an electrical characteristic of the display panel. The display driver includes a first amplifier circuit. The first amplifier circuit is coupled to the display panel. The first amplifier circuit includes a first driving circuit, a first sensing circuit and a first operational amplifier. The first operational amplifier is coupled to the display panel through a first driving line and a first sensing line. The first driving circuit is configured to provide a first driving signal to the display panel through the first operational amplifier and the first driving line during a driving period. The first sensing circuit is configured to receive a first sensing signal from the display panel through the first operational amplifier and the first sensing line during a first sensing period.

24 Claims, 6 Drawing Sheets

DISPLAY DRIVER AND DISPLAY DRIVING METHOD

BACKGROUND

Technical Field

The disclosure relates to a driver circuit, and particularly relates to a display driver and a display driving method.

Description of Related Art

In general, owing to the organic light emitting diode (OLED) display panel has a problem of the light brightness attenuation, the conventional display driver must be configured with additional current integrator circuits to sense the OLED display panel. Therefore, the conventional display driver of the OLED display panel has problems of high cost and high power consumption. Therefore, regarding how to reduce the cost of the display driver and achieve the effect of power saving, solutions of several embodiments are provided below.

SUMMARY

The disclosure is directed to a display driver and a display driving method, and are capable of driving a display panel and sensing an electrical characteristic of the display panel.

The display driver of the disclosure is adapted for driving a display panel and sensing an electrical characteristic of the display panel. The display driver includes a first amplifier circuit. The first amplifier circuit is coupled to the display panel. The first amplifier circuit includes a first driving circuit, a first sensing circuit and a first operational amplifier. The first operational amplifier is coupled to the display panel through a first driving line and a first sensing line. The first driving circuit is coupled to the first operational amplifier. The first driving circuit is configured to provide a first driving signal to the display panel through the first operational amplifier and the first driving line during a driving period. The first sensing circuit is coupled to the first operational amplifier. The first sensing circuit is configured to receive a first sensing signal from the display panel through the first operational amplifier and the first sensing line during a first sensing period.

The display driving method of the disclosure is adapted to a display driver. The display driver includes a first amplifier circuit coupled to the display panel through a first driving line and a first sensing line. The first amplifier circuit includes a first driving circuit, a first sensing circuit and a first operational amplifier. The display driving method includes following steps. A first driving signal is provided by the first driving circuit to the display panel through the first operational amplifier and the first driving line during a driving period. A first sensing signal is received by the first sensing circuit from the display panel through the first operational amplifier and the first sensing line during a first sensing period.

Based on the above, according to the display driver and the display driving method of the disclosure, the display driver is capable of driving a display panel and sensing an electrical characteristic of the display panel by one operational amplifier to reduce the number of operational amplifiers in the display driver, and reduce the cost of the display driver.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

It is to be understood that other embodiments may be utilized and structural changes may be made without departing from the scope of the disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
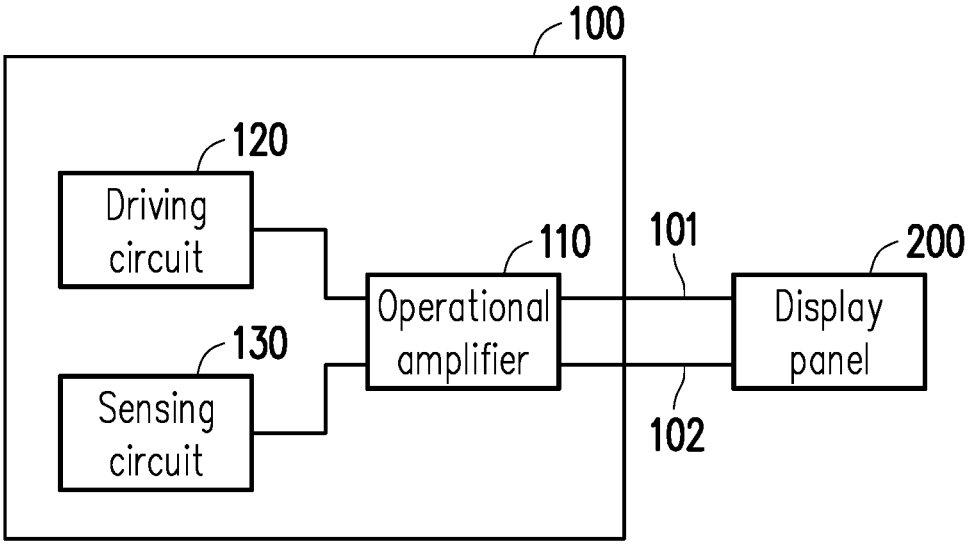
FIG. 1 is a schematic diagram illustrating an amplifier circuit according to an embodiment of the disclosure.

FIG. 1 is a circuit diagram illustrating an amplifier circuit according to an embodiment of the disclosure. Referring to FIG. 1, the amplifier circuit 100 includes an operational amplifier 110, a driving circuit 120 and a sensing circuit 130. The operational amplifier 110 is coupled to a display panel 200 through a driving line 101 and a sensing line 102, and the operational amplifier 110 is coupled to the driving circuit 120 and the sensing circuit 130. In the embodiment of the disclosure, the driving circuit 120 is configured to provide a driving signal to the display panel 200 through the operational amplifier 110 and the driving line 101 during a driving period. The sensing circuit 130 is configured to receive a sensing signal from the display panel 200 through the operational amplifier 110 and the sensing line 102 during a sensing period. That is, the amplifier circuit 100 is capable of driving the display panel 200 and sensing an electrical characteristic of the display panel 200 by the one operational amplifier 110 in different periods. In other words, the amplifier circuit 100 does not require multiple operational amplifier to implement the functions of driving and sensing the display panel 200. Therefore, the amplifier circuit 100 has the advantage of lower cost and lower area.

In the embodiment of the disclosure, the display panel 200 includes a pixel array, the pixel array includes a plurality of pixels arranged in an array. The plurality of pixels may include at least one of a plurality red pixels, a plurality green pixels, a plurality blue pixels or a plurality white pixels. The display panel 200 may be an organic light emitting diode (OLED) display panel or a micro light emitting diode (LED) display panel, and the disclosure is not limited thereto. In the embodiment of the disclosure, the amplifier circuit 100 may be corresponded to one or more pixel of the display panel. In another embodiment of the disclosure, the amplifier circuit 100 may be coupled to one pixel through the driving line 101 for driving the one pixel, and coupled to another one pixel through the sensing line 102 for sensing the another one pixel, where the one pixel and the another one pixel may be same color pixels or different color pixels.

In the embodiment of the disclosure, the driving circuit 120 may include a receiver circuit (RX), a digital to analog converter (DAC) circuit, and so on. The driving circuit 120 is configured to provide the driving signal to one pixel of the display panel 200 during the driving period. In the embodiment of the disclosure, the sensing circuit 130 may include a transmitter circuit (TX), an analog to digital converter (ADC) circuit, and so on. The sensing circuit 130 is configured to obtain the sensing signal from the one pixel or another one pixel of the display panel 200 during the sensing period, and provide a processed signal to a post-stage processing circuit, so that the post-stage processing circuit may perform a determination of a light brightness attenuation degree of the display panel 200 to further perform a driving compensation on the display panel 200 accordingly.

Figure 2:
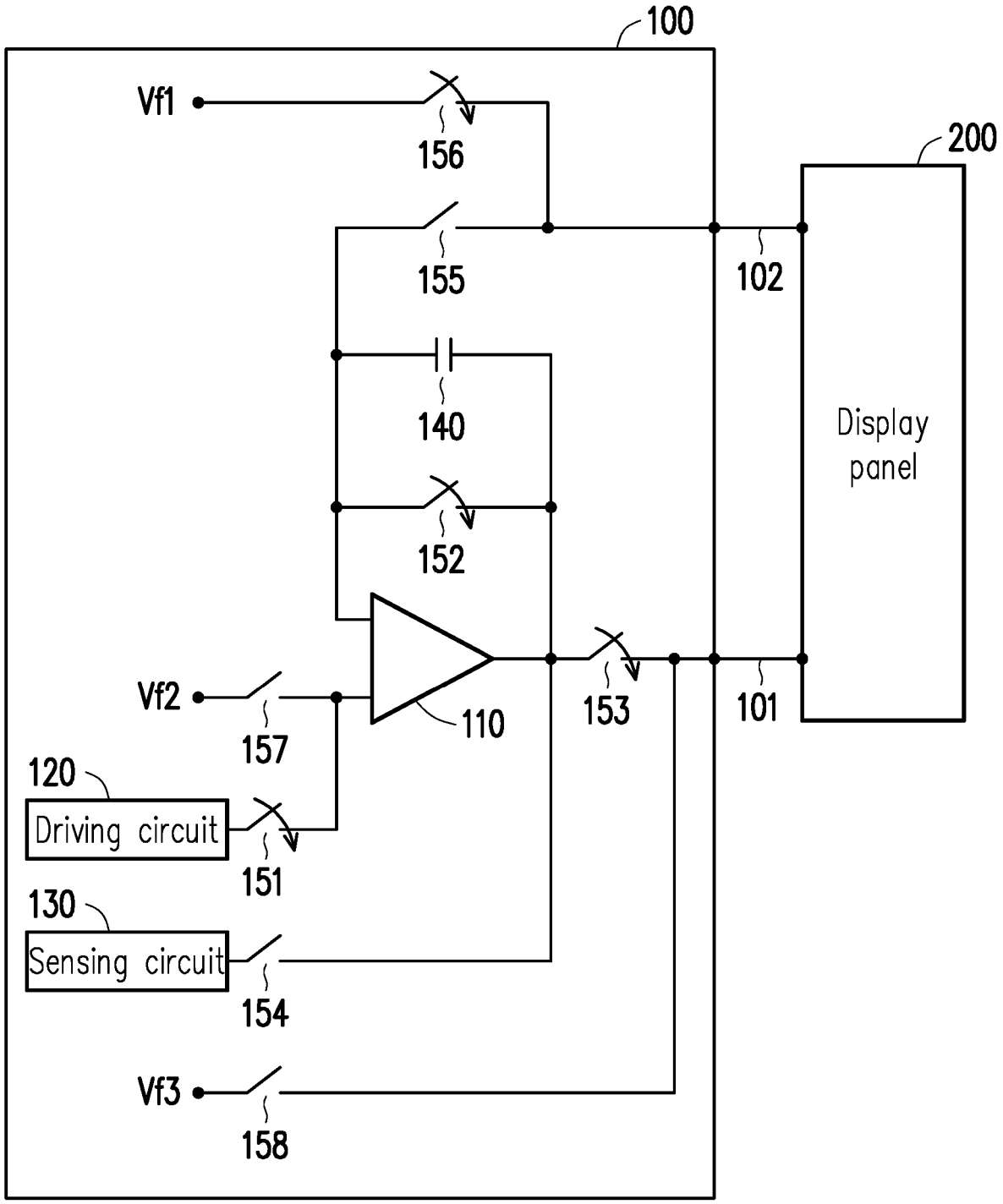
FIG. 2 is a circuit diagram illustrating the amplifier circuit operating in a driving mode according to an embodiment of the disclosure.

FIG. 2 is a circuit diagram illustrating the amplifier circuit operating in a driving mode according to an embodiment of the disclosure. Referring to FIG. 2, a detailed circuit architecture of the amplifier circuit 100 of the FIG. 1 is shown. Compared to FIG. 1, the amplifier circuit 100 further includes a capacitor 140 and a plurality of switches 151 to 158. In the embodiment of the disclosure, the switches 151 to 158 may be a plurality of N-type, P-type switching transistors or a plurality of transmission gates, and the disclosure is not limited thereto. In the embodiment of the disclosure, a first input terminal of the operational amplifier 110 is coupled to the driving circuit 120. A second input terminal of the operational amplifier 110 is coupled to the display panel 200 through a sensing line 102. An output terminal of the operational amplifier 110 is coupled to the sensing circuit 130 and coupled to the display panel 200 through the driving line 101. The capacitor 140 is coupled between the second input terminal and the output terminal of the operational amplifier 110.

In the embodiment of the disclosure, the switch 151 is coupled between the driving circuit 120 and the first input terminal of the operational amplifier 110. The switch 152 is coupled between the second input terminal and the output terminal of the operational amplifier 110. The switch 153 is coupled between the output terminal of the operational amplifier 110 and the driving line 101. The switch 154 is coupled between the sensing circuit 130 and the output terminal of the operational amplifier 110. The switch 155 is coupled between the second input terminal and the sensing line 102. The switch 156 is coupled between a reference voltage Vf1 and the sensing line 102. The switch 157 is coupled between a reference voltage Vf2 and the first input terminal of the operational amplifier 110. The switch 158 is coupled between a reference voltage Vf3 and the output terminal of the operational amplifier. In the embodiment of the disclosure, the first input terminal of the operational amplifier 110 may be a non-inverting input terminal, and the second input terminal of the operational amplifier 110 may be an inverting input terminal. It should be noted that, the amplifier circuit 100 may further include a control circuit, and the control circuit is configured to control the switches 151 to 158.

In the embodiment of the disclosure, the amplifier circuit 100 is a hybrid buffer structure, and the amplifier circuit 100 can be operated in a driving mode and a sensing mode in different periods. During the driving period, the amplifier circuit 100 is operated in a driving mode. More specifically, the switches 151, 152 and 153 are turned on, and the switches 154 and 155 are turned off, so that the operational amplifier 110 is operated as a voltage follower. Therefore, the driving circuit 120 may provide the driving signal to the display panel 200 through the operational amplifier 110 and the driving line 101 during the driving period. Therefore, the amplifier circuit 100 is capable of effectively providing the driving signal for driving the one pixel of display panel 200. In addition, during the driving period, the switch 156 may also be turned on, so as to provide the reference voltage Vf1 to the display panel 200 through the sensing line 102. In another embodiment of the disclosure, the amplifier circuit 100 may not include the switch 156.

Figure 3:
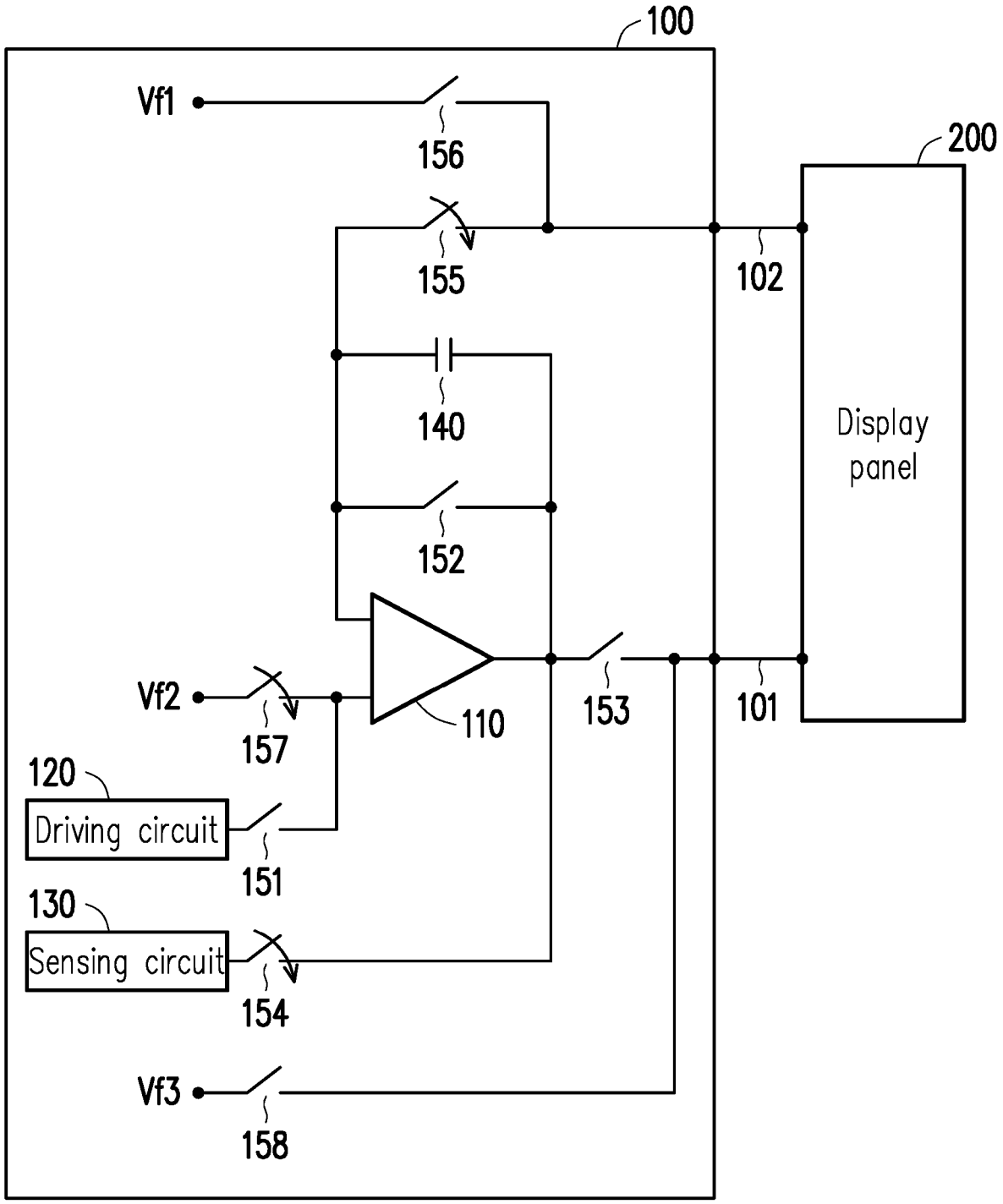
FIG. 3 is a circuit diagram illustrating the amplifier circuit operating in a sensing mode according to an embodiment of the disclosure.

FIG. 3 is a circuit diagram illustrating the amplifier circuit operating in a sensing mode according to an embodiment of the disclosure. Referring to FIG. 3, during the sensing period, the amplifier circuit 100 is operated in a sensing mode. More specifically, in the embodiment of the disclosure, the switches 151, 152 and 153 are turned off, and the switches 154, 155 and 157 are turned on, so that the operational amplifier 110 and the capacitor 140 are operated as a current integrator. The reference voltage Vf2 is provided through the switch 157 to the first input terminal of the operational amplifier 110. For example, the capacitor 140 may configured to receive a sensing current form the one pixel or another one pixel in the display panel 200 during the sensing period, so as to store a corresponding integrated value and provide the corresponding integrated value to the sensing circuit 130. Therefore, the driving circuit 120 may receive the sensing signal from the one pixel or another one pixel in the display panel 200 through the operational amplifier 110 and the sensing line 102 during the sensing period. Therefore, the amplifier circuit 100 is capable of effectively receiving the sensing signal for sensing the light brightness attenuation degree of the display panel 200. In addition, during the sensing period, the switch 158 may also be turned on, so as to provide the reference voltage Vf3 to display panel 200 through the driving line 101, where the reference voltage Vf3 may be a ground voltage.

Figure 4:
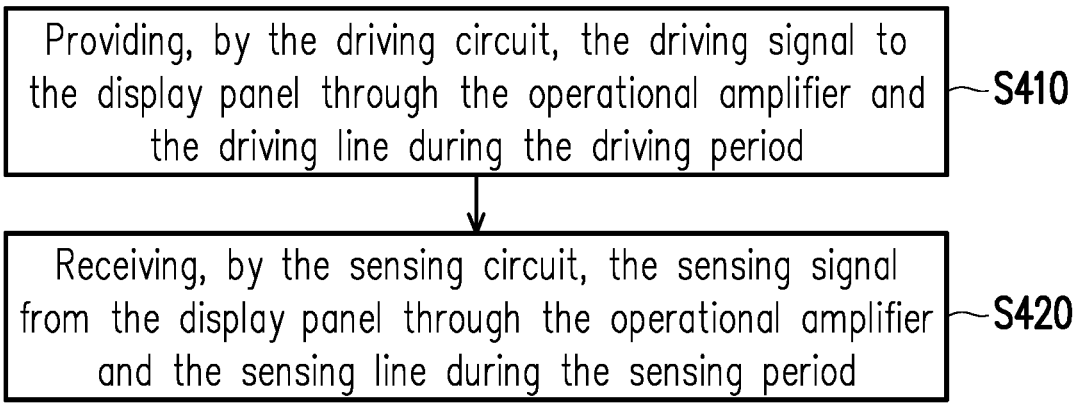
FIG. 4 is a flowchart of a display driving method according to an embodiment of the disclosure.

FIG. 4 is a flowchart of a display driving method according to an embodiment of the disclosure. Referring to FIG. 1 and FIG. 4, the display driving method of display driving method may be at least adapted to the display driver 100 of FIG. 1. In step S410, the driving circuit 120 provides the driving signal to the display panel 200 through the operational amplifier 110 and the driving line 101 during the driving period. In step S420, the sensing circuit 130 receives the sensing signal from the display panel 200 through the operational amplifier 110 and the sensing line 102 during the sensing period. Therefore, the amplifier circuit 100 applied by the display driving method of this disclosure is capable of driving the display panel 200 and sensing an electrical characteristic of the display panel 200 by the one operational amplifier 110 in the different periods. In addition, enough teachings and recommendations for related internal circuits of the display driver 100, implementation details and technical features of the display driver 100 of the embodiment may be learned from related descriptions of the embodiments of FIG. 1 to FIG. 3, and details thereof are not repeated.

Figure 5:
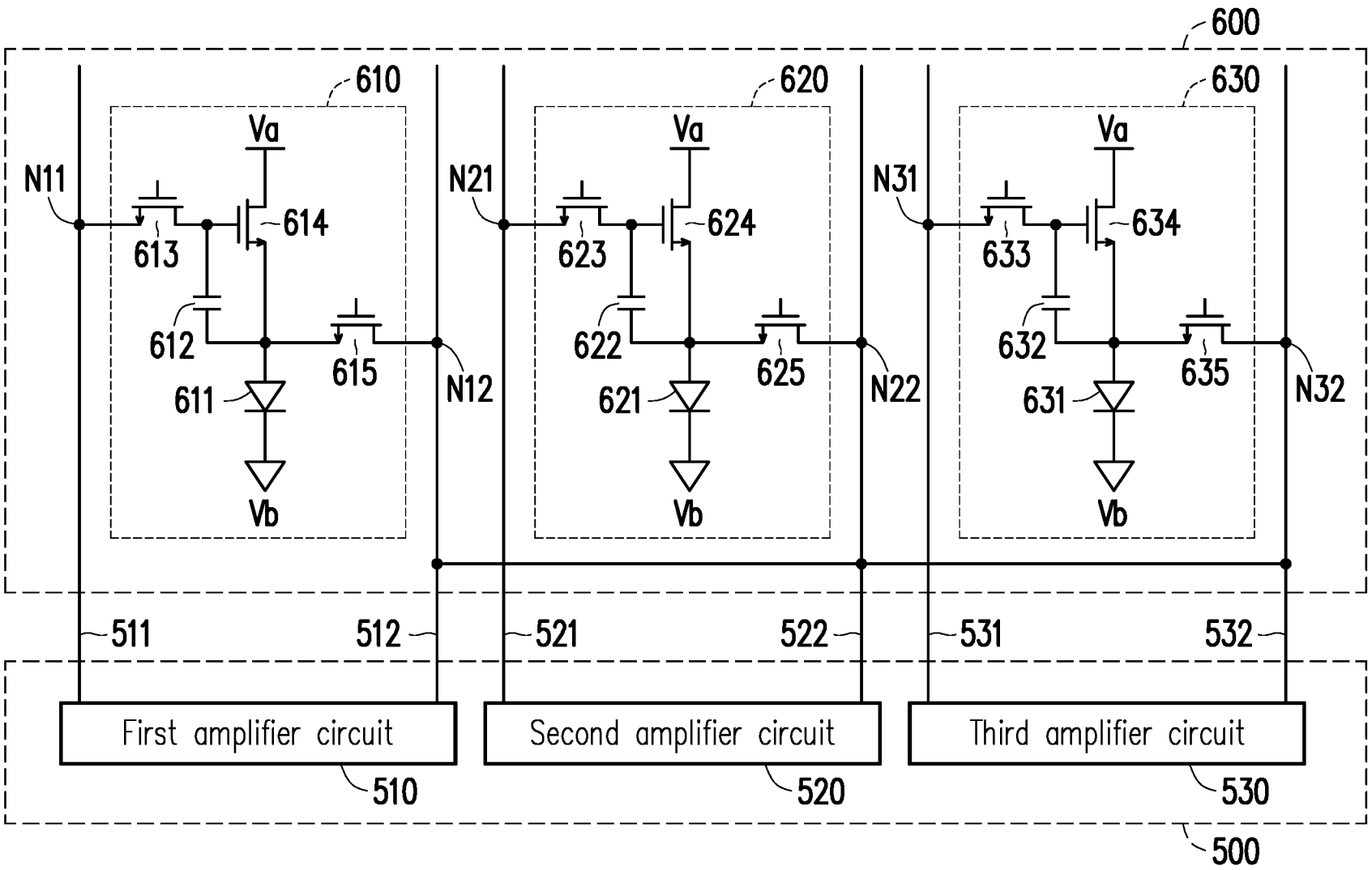
FIG. 5 is a circuit diagram illustrating a display driver and a display panel according to an embodiment of the disclosure.

FIG. 5 is a circuit diagram illustrating a display driver and a display panel according to an embodiment of the disclosure. Referring to FIG. 5, the display driver 500 may include a first amplifier circuit 510, a second amplifier circuit 520 and a third amplifier circuit 530, and the display panel 600 may include a first pixel 610, a second pixel 620 and a third pixel 630. The first pixel 610 may be a red pixel, the second pixel 620 may be a green pixel and the third pixel 630 may be a blue pixel, but the disclosure is not limited thereto. In the embodiment of the disclosure, the first amplifier circuit 510 is corresponded to the first pixel 610, and the first amplifier circuit 510 is coupled to the first pixel 610 through a first driving line 511 and a first sensing line 512. The second amplifier circuit 520 is corresponded to the second pixel 620, and the second amplifier circuit 520 is coupled to the second pixel 620 through a second driving line 521 and a second sensing line 522. The third amplifier circuit 530 is corresponded to the third pixel 630, and the third amplifier circuit 530 is coupled to the third pixel 630 through a first driving line 531 and a sensing line 532.

In the embodiment of the disclosure, the first pixel 610 includes a photo diode 611, a storage capacitor 612 and transistor 613 to 615. A first terminal of the photo diode 611 is coupled to a reference voltage Vb. A first terminal of the storage capacitor 612 is coupled to a second terminal of the photo diode 611. A first terminal of the transistor 613 is coupled to a second terminal of the storage capacitor 612, and a second terminal of the transistor 613 is coupled to the first driving line 511 via the circuit node N11. A first terminal of the transistor 614 is coupled to a reference voltage Va, a second terminal of the transistor 614 is coupled to the second terminal of the photo diode 611, and a control terminal of the transistor 614 is coupled to the first terminal of the photo diode 611. A first terminal of the transistor 615 is coupled to the first sensing line 513 via the circuit node N12, and a second terminal of the transistor 615 is coupled to first terminal of the photo diode 611. In the embodiment of the disclosure, the second pixel 620 includes a photo diode 621, a storage capacitor 622 and transistor 623 to 625, and the third pixel 630 includes a photo diode 631, a storage capacitor 632 and transistor 633 to 635. The second pixel 620 and the third pixel 630 has same circuit architecture as the first pixel 610, and respectively coupled to the second amplifier circuit 520 and the third amplifier circuit 530 in the same coupling manner, therefore details circuit of the second pixel 620 and the third pixel 630 are not repeated. In the embodiment of the disclosure, the first sensing line 512, the second sensing line 522 and the third sensing line 532 are coupled together.

It should be noted that, the first amplifier circuit 510, the second amplifier circuit 520 and the third amplifier circuit 530 each include same circuit units as the amplifier circuit 100 of FIG. 2 and FIG. 3. Therefore, referring to FIG. 2, FIG. 3 and FIG. 5, during a driving period, the first amplifier circuit 510, the second amplifier circuit 520 and the third amplifier circuit 530 provide first to third driving signals to the first pixel 610, the second pixel 620 and the third pixel 630 through the first driving line 511, the second driving line 521 and the third driving line 531. In detail, during the driving period, the first to third driving signals are respectively provided to the transistors 614, 624 and 634, so that the transistors 614, 624 and 634 drive the photo diodes 611, 621 and 631 accordingly the voltage levels of the first to third driving signals. Besides, corresponding to the turn-on result of the switch 156 in FIG. 2, the first amplifier circuit 510, the second amplifier circuit 520 and the third amplifier circuit 530 may further provide reference voltages Vf1 to the first terminals of the transistors 615, 625 and 635 through the first sensing line 512, the second sensing line 522 and the third sensing line 532.

Taking the second amplifier circuit 520 senses the first pixel 610 as an example, the first amplifier circuit 510 provides the first driving signal or other driving signal to the first pixel 610 through the first driving line 511 during a first sensing period, so that the transistor 614 is turned on by the transistor 613. Then, the second amplifier circuit 520 receives a sensing signal from the transistor 614 through the transistor 615, the circuit node N12 and the second sensing line 522 during the first sensing period. In the embodiment of the disclosure, the above sensing signal may be, for example, a source-to-drain current of the transistor 614. Thus, the operational amplifier (such as the operational amplifier 110 in FIG. 3) and the capacitor (such as the capacitor 140 in FIG. 3) of the second amplifier circuit 520 may integrate the source-to-drain current, and outputs a corresponding integrated value to the sensing circuit of the second amplifier circuit 520, so that the post-stage processing circuit can effectively determine the light brightness attenuation degree of the display panel 200 according to the change of the source-to-drain current of the transistor 614.

Further, owing to the second pixel 620 and the third pixel 630 are idle, therefore corresponding to the turn-on result of the switch 158 in FIG. 3, the second amplifier circuit 520 and the third amplifier circuit 530 may further provide the reference voltage Vf3 to the second pixel 620 and the third pixel 630 through the second driving line 521 and the third driving line 531, where the reference voltage Vf3 may be a ground voltage. That is, owing the second pixel 620 and the third pixel 630 are directly turned off by controlling one transistor (such as the switch 158 in FIG. 3) rather than a turn off signal outputted from the second amplifier circuit 520 or the third amplifier circuit 530 during the first period, therefore display driver 500 may achieve the effect of power saving.

However, in another embodiment of the disclosure, the first pixel 610 may also be sensed by the third amplifier circuit 530. By that analogy, the second pixel 620 may be sensed by the first amplifier circuit 510 or the third amplifier circuit 530 during a second sensing period, and the third pixel 630 may be sensed by the first amplifier circuit 510 or the second amplifier circuit 520 during a third sensing period. In other words, each of pixels in the display panel 600 may be sensed by the amplifier circuit of the respective adjacent pixel without an additional amplifier circuit. Therefore, the display driver 500 of the disclosure can effectively reduce number of operational amplifiers, and reduce the cost of the display driver 500.

Figure 6:
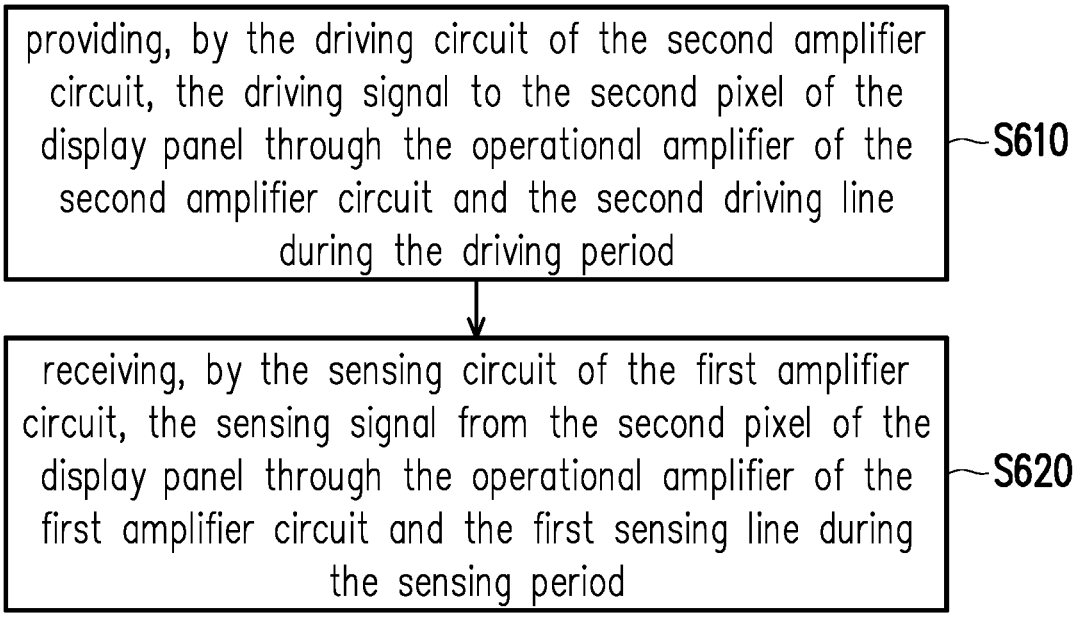
FIG. 6 is a flowchart of a display driving method according to another embodiment of the disclosure.

FIG. 6 is a flowchart of a display driving method according to another embodiment of the disclosure. Referring to FIG. 5 and FIG. 6, the display driving method of display driving method may be at least adapted to the display driver 500 of FIG. 5. In step S610, the driving circuit of the second amplifier circuit 520 provides the driving signal to the second pixel 620 of the display panel 200 through the operational amplifier of the second amplifier circuit 520 and the second driving line 521 during the driving period. In step S620, the sensing circuit of the first amplifier circuit 510 receives the sensing signal from the second pixel 620 of the display panel 200 through the operational amplifier of the first amplifier circuit 510 and the first sensing line 511 during the sensing period. Therefore, the amplifier driver 500 applied by the display driving method of this disclosure is capable of effectively sensing an electrical characteristic of the display panel 600. In addition, enough teachings and recommendations for related internal circuits of the display driver 500, implementation details and technical features of the display driver 500 of the embodiment may be learned from related descriptions of the embodiments of FIG. 1 to FIG. 5, and details thereof are not repeated.

In summary, the display driver and the display driving method of the disclosure are capable of performing the driving operation and the sensing operation in different period through one operational amplifier by controlling the multiple switches, where the one operational amplifier is operated as a current integrator or a voltage follower in the different period. In other words, the display driver of the disclosure no need additional current integrator circuits to sense the display panel. Therefore, the display driver and the display driving method of the disclosure can effectively reduce the cost of the display driver and achieve the effect of power saving by a specific amplifier circuit design.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display driver, adapted for driving a display panel and sensing an electrical characteristic of the display panel, wherein the display driver comprises:

a first amplifier circuit, coupled to the display panel, wherein the first amplifier circuit comprises:

a first operational amplifier, coupled to the display panel through a first driving line and a first sensing line;

a first driving circuit, coupled to the first operational amplifier, and configured to provide a first driving signal to the display panel through the first operational amplifier and the first driving line during a driving period; and a first sensing circuit, coupled to the first operational amplifier, and configured to receive a first sensing signal from the display panel through the first operational amplifier and the first sensing line during a first sensing period.

2. The display driver according to the claim 1, wherein a first input terminal of the first operational amplifier is coupled to the first driving circuit, a second input terminal of the first operational amplifier is coupled to the display panel through the first sensing line, and an output terminal of the first operational amplifier is coupled to the first sensing circuit and coupled to the display panel through the first driving line.

3. The display driver according to the claim 2, wherein the first amplifier circuit further comprises:

a first switch, coupled between the first driving circuit and the first input terminal of the first operational amplifier;

a second switch, coupled between the second input terminal and the output terminal of the first operational amplifier;

a third switch, coupled between the output terminal of the first operational amplifier and the first driving line;

a fourth switch, coupled between the first sensing circuit and the output terminal of the first operational amplifier;

a fifth switch, coupled between the second input terminal and the first sensing line; and a first capacitor, coupled between the second input terminal and the output terminal of the first operational amplifier.

4. The display driver according to the claim 3, wherein during the driving period, the first switch, the second switch and the third switch are turned on, and the fourth switch and the fifth switch are turned off, so that the first operational amplifier is operated as a voltage follower and provides the first driving signal to the display panel.

5. The display driver according to the claim 4, wherein first amplifier circuit further comprises:

a sixth switch, coupled between a first reference voltage and the first sensing line, wherein the sixth switch is turned on during the driving period.

6. The display driver according to the claim 3, wherein during the first sensing period, the first switch, the second switch and the third switch are turned off, and the fourth switch and the fifth switch are turned on, so that the first operational amplifier and the first capacitor are operated as a current integrator and provide the first sensing signal to the first sensing circuit.

7. The display driver according to the claim 6, wherein first amplifier circuit further comprises:

a seventh switch, coupled between a second reference voltage and the first input terminal of the first operational amplifier, wherein the seventh switch is turned on during the first sensing period.

8. The display driver according to the claim 3, wherein first amplifier circuit further comprises:

an eighth switch, coupled between a third reference voltage and the output terminal of the first operational amplifier, wherein the eighth switch is turned off during the driving period, and the eighth switch is turned on during the first sensing period.

9. The display driver according to the claim 1, wherein the first amplifier circuit is coupled to a first pixel of the display panel through the first sensing line and the first driving line, and the display driver further comprises:

a second amplifier circuit, coupled to a second pixel of the display panel, wherein the second amplifier circuit comprises:

a second operational amplifier, coupled to the second pixel of the display panel through a second driving line; and a second driving circuit, coupled to the second operational amplifier, and configured to provide a second driving signal to the second pixel of the display panel through the second operational amplifier and the second driving line during the driving period, wherein the first driving circuit is configured to provide the first driving signal to the first pixel of the display panel through the first operational amplifier and the first driving line during the driving period.

10. The display driver according to the claim 9, wherein a second sensing line is coupled to the second pixel of the display panel, and the first sensing line is coupled to the second sensing line, wherein the second driving circuit of the second amplifier circuit is further configured to provide the second driving signal to the second pixel of the display panel through the second operational amplifier and the second driving line during the first sensing period, and the first sensing circuit of the first amplifier circuit is configured to receive the first sensing signal from the second pixel of the display panel through the first operational amplifier and the second sensing line during the first sensing period.

11. The display driver according to the claim 9, wherein the second operational amplifier is coupled to the second pixel of the display panel further through a second sensing line, and the first sensing line is coupled to the second sensing line, wherein the second amplifier circuit further comprises:

a second sensing circuit, coupled to the second operational amplifier, and configured to receive a second sensing signal from the first pixel of the display panel through the second operational amplifier and the first sensing line during a second sensing period.

12. The display driver according to the claim 11, wherein the first driving circuit is further configured to provide the first driving signal to the first pixel of the display panel through the first operational amplifier and the first driving line during the second sensing period.

13. A display driving method, adapted to a display driver, wherein the display driver comprises a first amplifier circuit coupled to the display panel through a first driving line and a first sensing line, and the first amplifier circuit comprises a first driving circuit, a first sensing circuit and a first operational amplifier, wherein the display driving method comprises:

providing, by the first driving circuit, a first driving signal to the display panel through the first operational amplifier and the first driving line during a driving period; and receiving, by the first sensing circuit, a first sensing signal from the display panel through the first operational amplifier and the first sensing line during a first sensing period.

14. The display driving method according to the claim 13, wherein a first input terminal of the first operational amplifier is coupled to the first driving circuit, a second input terminal of the first operational amplifier is coupled to the display panel through the first sensing line, and an output terminal of the first operational amplifier is coupled to the first sensing circuit and coupled to the display panel through the first driving line.

15. The display driving method according to the claim 14, wherein the first amplifier circuit further comprises a first switch coupled between the first driving circuit and a first input terminal of the first operational amplifier, a second switch coupled between a second input terminal and the output terminal of the first operational amplifier, a third switch coupled between an output terminal of the first operational amplifier and the first driving line, a fourth switch coupled between the first sensing circuit and the output terminal of the first operational amplifier, a fifth switch coupled between the second input terminal and the first sensing line, and a first capacitor coupled between the second input terminal and the output terminal of the first operational amplifier.

16. The display driving method according to the claim 15, wherein the step of providing, by the first driving circuit, the first driving signal to the display panel through the first operational amplifier and the first driving line during the driving period comprises:

during the driving period, turning on the first switch, the second switch and the third switch, and turning off the fourth switch and the fifth switch, wherein the first operational amplifier is operated as a voltage follower and provides the first driving signal to the display panel.

17. The display driving method according to the claim 16, wherein first amplifier circuit further comprises a sixth switch coupled between a first reference voltage and the first sensing line, and the sixth switch is turned on during the driving period.

18. The display driving method according to the claim 15, wherein the step of receiving, by the first sensing circuit, the first sensing signal from the display panel through the first operational amplifier and the first sensing line during the first sensing period comprises:

during the first sensing period, turning off the first switch, the second switch and the third switch, and turning on the fourth switch and the fifth switch, wherein the first operational amplifier and the first capacitor are operated as a current integrator and provide the first sensing signal to the first sensing circuit.

19. The display driving method according to the claim 18, wherein first amplifier circuit further comprises a seventh switch coupled between a second reference voltage and the first input terminal of the first operational amplifier, and the seventh switch is turned on during the first sensing period.

20. The display driving method according to the claim 15, wherein first amplifier circuit further comprises an eighth switch coupled between a third reference voltage and the output terminal of the first operational amplifier, wherein the eighth switch is turned off during the driving period, and the eighth switch is turned on during the first sensing period.

21. The display driving method according to the claim 13, wherein the first amplifier circuit is coupled to a first pixel of the display panel through the first sensing line and the first driving line, and the display driver further comprises a second amplifier circuit coupled to a second pixel of the display panel by a second driving line, wherein the second amplifier circuit comprises a second driving circuit, a second sensing circuit and a second operational amplifier, wherein the step of providing, by the first driving circuit, the first driving signal to the display panel through the first operational amplifier and the first driving line during the driving period comprises:

providing, by the first driving circuit, the first driving signal to the first pixel of the display panel through the first operational amplifier and the first driving line during the driving period; and providing, by the second driving circuit, a second driving signal to the second pixel of the display panel through the second operational amplifier and the second driving line during the driving period.

22. The display driving method according to the claim 21, wherein a second sensing line is coupled to the second pixel of the display panel, and the first sensing line is coupled to the second sensing line, and the step of receiving, by the first sensing circuit, the first sensing signal from the display panel through the first operational amplifier and the first sensing line during the first sensing period comprises:

providing, by the second driving circuit, the second driving signal to the second pixel of the display panel through the second operational amplifier and the second driving line during the first sensing period; and receiving, by the first sensing circuit, the first sensing signal from the second pixel of the display panel through the first operational amplifier and the second sensing line during the first sensing period.

23. The display driving method according to the claim 21, wherein the second operational amplifier is coupled to the second pixel of the display panel further through a second sensing line, and the first sensing line is coupled to the second sensing line, and the second amplifier circuit further comprises a second sensing circuit, wherein the display driving method further comprising:

receiving, by a second sensing circuit, a second sensing signal from the first pixel of the display panel through the second operational amplifier and the first sensing line during a second sensing period.

24. The display driving method according to the claim 23, wherein the display driving method further comprising:

providing, by the first driving circuit, the first driving signal to the first pixel of the display panel through the first operational amplifier and the first driving line during the second sensing period.

* * * * *